US011228141B2

(12) United States Patent
Miyamura et al.

(10) Patent No.: US 11,228,141 B2
(45) Date of Patent: Jan. 18, 2022

(54) CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP); TOYOTA JIDOSHA KABUSHIKI KAISHA, Aichi (JP)

(72) Inventors: Tetsuya Miyamura, Mie (JP); Masaaki Tabata, Mie (JP); Yasuo Omori, Mie (JP); Teruo Hara, Mie (JP); Shunya Takeuchi, Mie (JP); Hiroki Kobayashi, Mie (JP); Hisashi Kojima, Mie (JP); Takeshi Misaiji, Aichi-ken (JP); Hiroshi Kobayashi, Aichi-ken (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP); TOYOTA JIDOSHA KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/968,238

(22) PCT Filed: Jan. 30, 2019

(86) PCT No.: PCT/JP2019/003070
§ 371 (c)(1),
(2) Date: Aug. 7, 2020

(87) PCT Pub. No.: WO2019/159691
PCT Pub. Date: Aug. 22, 2019

(65) Prior Publication Data

US 2021/0036460 A1 Feb. 4, 2021

(30) Foreign Application Priority Data

Feb. 15, 2018 (JP) ..... JP2018-025370

(51) Int. Cl.
*H01R 13/629* (2006.01)
*H01R 13/50* (2006.01)

(52) U.S. Cl.
CPC ..... *H01R 13/629* (2013.01); *H01R 13/50* (2013.01)

(58) Field of Classification Search
CPC ..... H01R 13/629; H01R 13/50
(Continued)

(56) References Cited

U.S. PATENT DOCUMENTS 4,413,872 A * 11/1983 Rudy, Jr. ..... H01R 4/2462 439/387
4,721,482 A * 1/1988 Fukuda ..... H01R 13/4223 439/586
(Continued)

FOREIGN PATENT DOCUMENTS

JP S15-000085 Y1 1/1940
JP S49-098795 U 8/1974
(Continued)

OTHER PUBLICATIONS

International Search Report issued in International Patent Application No. PCT/JP2019/003070, dated Mar. 19, 2019, together with an English translation thereof.
(Continued)

*Primary Examiner* — Alexander Gilman
(74) *Attorney, Agent, or Firm* — Greenblum & Bernstein, P.L.C.

(57) ABSTRACT

A connector includes a terminal that is to be contacted with a conductive member of a wire, a housing in which the terminal is arranged, and a holding member that is fit in the
(Continued)

housing and in contact with the terminal to hold a position of the terminal. At least one of the terminal and the housing includes a pressing portion that presses the conductive member in a direction such that the conductive member comes in contact with the terminal.

8 Claims, 14 Drawing Sheets

(58) Field of Classification Search
USPC ..... 439/153
See application file for complete search history.

(56) References Cited

U.S. PATENT DOCUMENTS 4,753,612 A * 6/1988 Betsui ..... H01R 13/4223 439/596
4,975,076 A * 12/1990 Mosquera ..... H01R 12/772 439/387
5,037,325 A * 8/1991 Wirkus ..... H01R 13/743 439/467
5,195,907 A * 3/1993 Urban ..... H01B 7/0823 439/406
5,328,386 A * 7/1994 Frantz ..... H01R 13/58 439/465
5,516,984 A * 5/1996 Soes ..... H01R 13/5829 439/467
5,545,054 A * 8/1996 Benes ..... H01R 13/422 439/467
5,573,421 A * 11/1996 Reichle ..... H01R 4/2433 439/409
5,697,819 A * 12/1997 Hatagishi ..... H01R 13/501 439/752
5,756,972 A * 5/1998 Vranicar ..... H01R 13/5205 219/541
6,186,821 B1 * 2/2001 Mullen, Jr. ..... H01R 13/501 439/409
6,843,682 B2 * 1/2005 Matsuda ..... H01R 4/48 439/596
7,140,905 B2 * 11/2006 Castaldo ..... H01R 13/5833 439/410

FOREIGN PATENT DOCUMENTS

JP 2015-056209 3/2015
JP 2016-009527 1/2016

OTHER PUBLICATIONS

Written Opinion issued in International Patent Application No. PCT/JP2019/003070, dated Mar. 19, 2019, together with an English translation thereof.

* cited by examiner

CONNECTOR

TECHNICAL FIELD

The technology disclosed herein relates to a connector.

BACKGROUND ART

A connector including a housing in which terminals connected to ends of wires are arranged has been known. The connector disclosed in Patent Document 1 includes terminals to which the wires are connected by crimping and a housing including a terminal housing section where the terminals are arranged. The terminals are retained by a lance member that projects from an inner wall of the terminal housing section.

RELATED ART DOCUMENT

Patent Document

[Patent Document 1] Japanese Unexamined Patent Application Publication No. 2016-9527

SUMMARY OF THE INVENTION

Problem to be Solved by the Invention

The connector has been demanded to be further downsized recently according to a configuration where the connector is mounted. This may lead the terminals that are arranged in the connector to be also downsized. For example, if the terminals to which the wires are connected by crimping with a wire barrel are used, the terminals are inserted in the terminal housing section of the housing after the crimping. In such a case, very thin wires of a small diameter are connected to the downsized terminals and therefore, the wires may be bent or warped when inserting the terminals into the terminal housing section.

The technology described herein was made in view of the above circumstances. An object is to provide a connector that can be downsized and suppress bending or warping of a wire.

Means for Solving the Problem

A connector disclosed herein includes a terminal that is to be contacted with a conductive member of a wire, a housing in which the terminal is arranged, and a holding member that is fit in the housing and in contact with the terminal to hold a position of the terminal. At least one of the terminal and the housing includes a pressing portion that presses the conductive member in a direction such that the conductive member comes in contact with the terminal.

According to the above configuration, the pressing portion presses the conductive member in a direction such that the conductive member comes in contact with the terminal after the conductive member of the wire is disposed on the terminal. Therefore, the problems such as bending or warping of the wire are less likely to be caused even with the downsized connector and the downsized terminal. The connector described before can be downsized while restricting the occurrence of the bending or warping of the wire. However, connection errors may occur between the terminal and the wire due to the wrong positioning of the pressing portion with respect to the conductive member since the connector is configured such that the pressing portion presses the conductive member in a direction such that the conductive member comes in contact with the terminal to connect the conductive member to the terminal. According to the above configuration, since the holding member that is to be mounted in the housing comes in contact with the terminal to keep the position of the terminal, the connection errors that may be caused between the terminal and the wire due to the wrong positioning of the pressing portion with respect to the conductive member are less likely to be caused.

Embodiments of the technology described herein may preferably include configurations as follows.

The terminal may include a holding portion that holds the conductive member while being in contact with the conductive member and a pressing portion that is a separate component from the holding portion and presses in a direction such that the holding portion holds the conductive member.

According to such a configuration, the wire can be connected to the terminal by moving the holding portion and the pressing portion relatively each other after setting the holding portion and the pressing portion in the housing. Therefore, the bending or warping of the wire can be restricted in a configuration including the downsized connector and the downsized terminal.

The pressing portion may be sandwiched between the housing and the holding member to be positioned.

According to such a configuration, since the pressing portion is positioned between the housing and the holding member, the holding portion can keep holding the conductive member of the wire via the pressing portion. This can simplify the configuration of the connector.

One of the housing and the holding member may include a fitting stopper that is fit to another one of the housing and the holding member while keeping a position of the terminal and a provisional fitting stopper that is provisionally fit to the other one of the housing and the holding member while not keeping the position of the terminal.

According to such a configuration, the housing and the holding member that are provisionally fit each other can be made in the fitting state. This can simplify the fitting operation of the connector.

The terminal may include a jig receiver that is configured to receive a jig when the holding member is provisionally fit in the housing, and the jig receiver that receives the jig may allow a relative position of the holding portion and the pressing portion to be moved with sliding.

Accordingly, the relative movement of the holding portion and the pressing portion becomes easy.

The holding member may include a body member that is to be in contact with the terminal, a cover member that is pivotably connected to the body member via a hinge portion, and a disposing portion that protrudes from the body member toward the cover member and on which the wire is disposed. The cover member may include a wire pressing portion that presses the wire disposed on the disposing portion toward the disposing portion.

According to such a configuration, even if the wire receives a force in a direction such that the terminal is to be removed, the wire pressing portion presses and holds the wire. This reduces stress that may be caused in a connection portion of the wire and the terminal.

Advantageous Effects of Invention

According to the technology disclosed herein, the connector can be downsized and bending or warping of a wire can be suppressed.

MODES FOR CARRYING OUT THE INVENTION

First Embodiment

A first embodiment will be described with reference to FIGS. 1 to 14.

A connector 10 in this embodiment is mounted in a vehicle such as an automobile and is to be fit to a target connector that is connected to ends of wires or a device. Hereinafter, in FIG. 1, an X-direction corresponds to a frontward direction, a Y-direction corresponds to a leftward direction, and a Z-direction corresponds to an upward direction.

Figure 3:
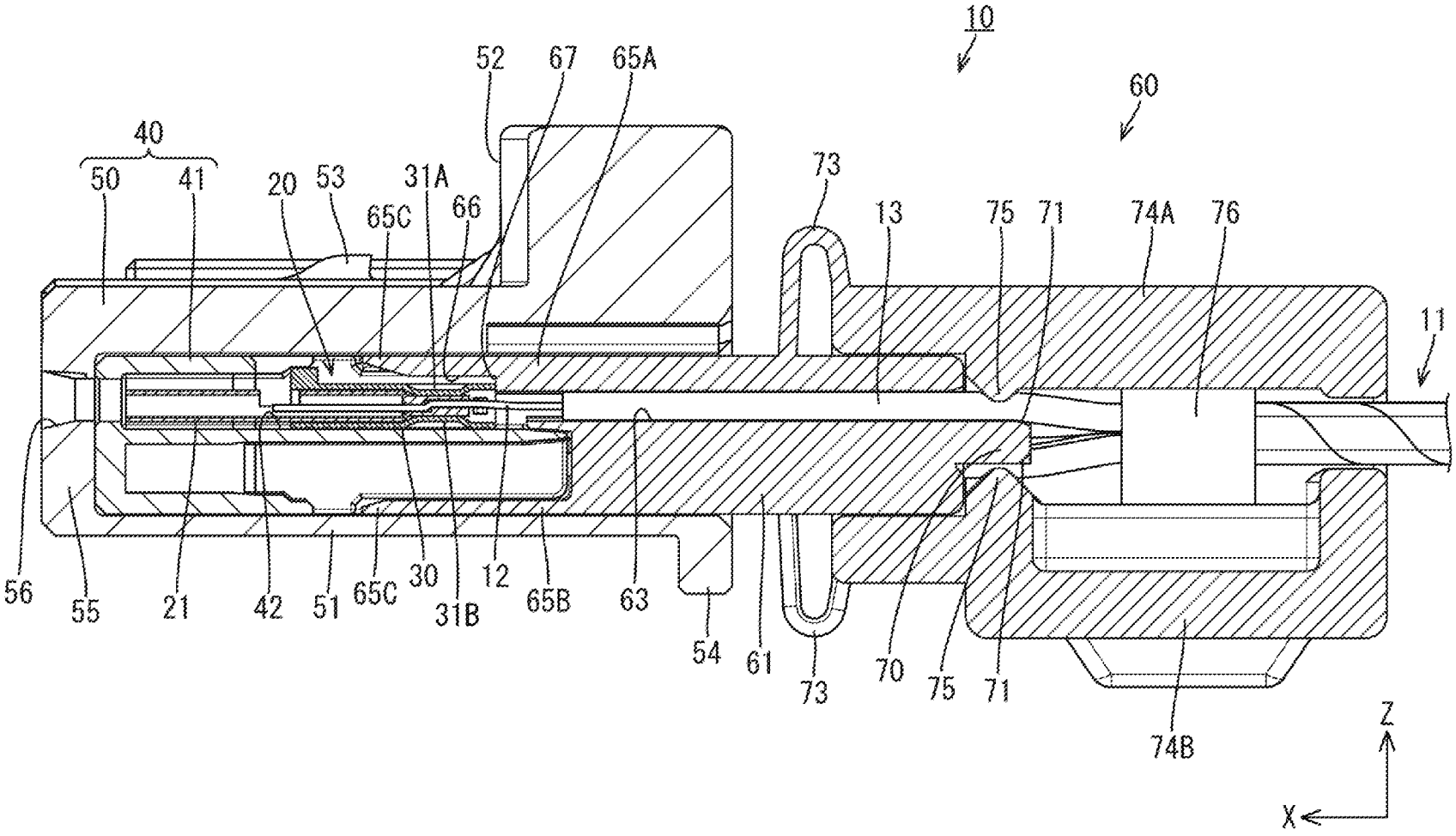
FIG. 3 is a cross-sectional view taken along line A-A in FIG. 2.

As illustrated in FIG. 3, the connector 10 includes terminals 20 that are connected to wires 11, a housing 40 including an inner housing 41 and an outer housing 50, and a holding member 60 that is to be mounted in the housing 40 and keeps a position of the terminals 20. The wires 11 include conductive members 12 made of copper, copper alloy, aluminum, aluminum alloy, or other material and insulating covers 13 that surround and cover the respective conductive members 12.

Figure 4:
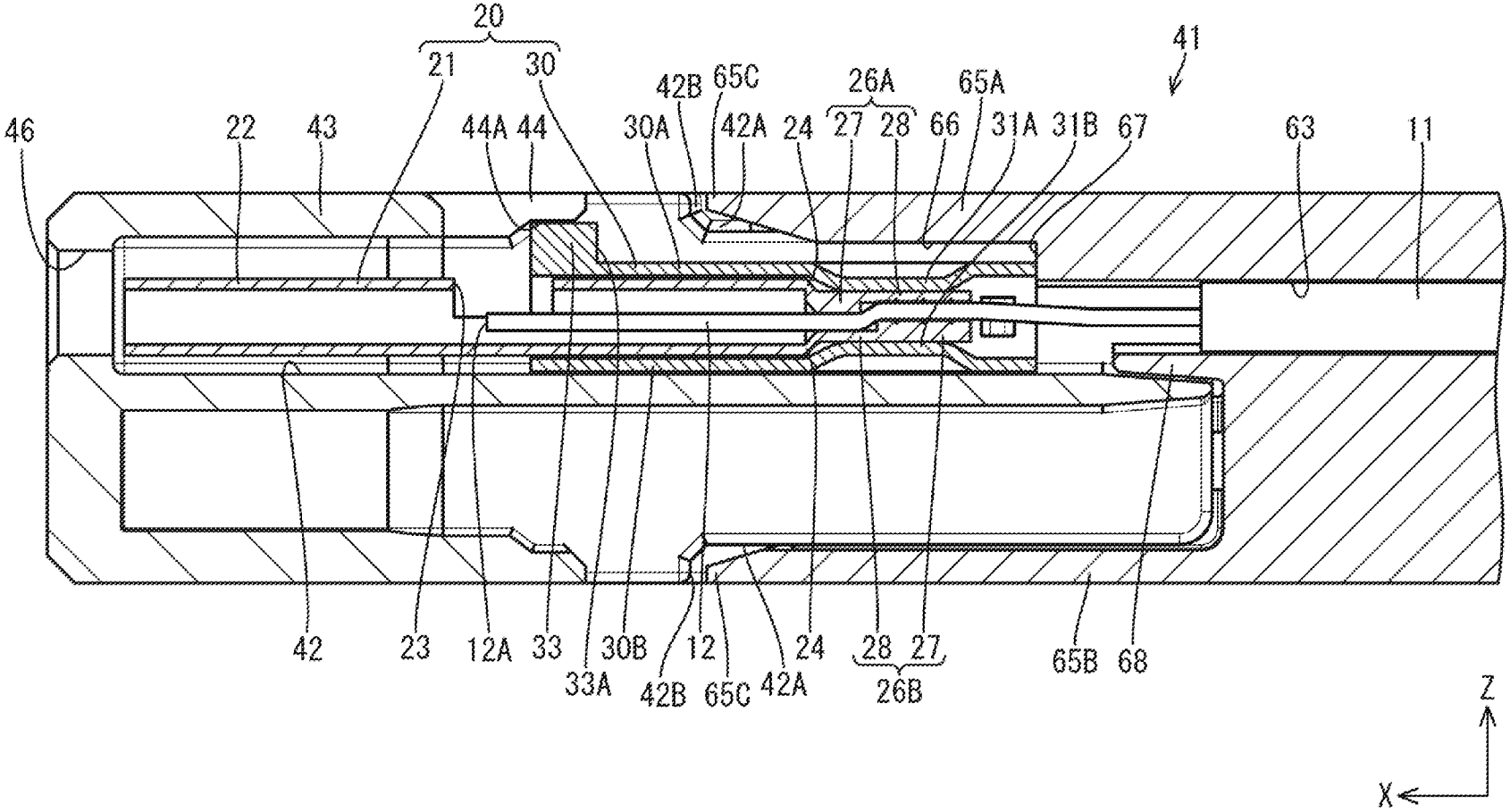
FIG. 4 is an enlarged cross-sectional view illustrating a front section of the connector from which an outer housing is detached.

As illustrated in FIG. 4, the terminal 20 includes a terminal body portion 21 and a pressing member 30 that is a different component from the terminal body portion 21. The terminal body portion 21 is a female terminal made of metal such as copper, copper alloy, aluminum, aluminum alloy, or other materials. The terminal body portion 21 includes a box portion 22 and an upper and lower pair of a holding portion 26A and a holding portion 26B. The box portion 22 has a square cylindrical shape and an elastic contact piece (not illustrated) that is to be connected to a target male terminal is arranged in the box portion 22. The pair of holding portions 26A, 26B is disposed continuously from a rear portion of the box portion 22 and sandwiches the conductive member 12 of the wire 11. The box portion 22 has a hole 23 in an upper portion (an outer surface of the inner housing 41) thereof and in a middle portion with respect to a front-rear direction. When the wire 11 is inserted into a correct position (a position illustrated in FIG. 4) with respect to the terminal 20, a distal end 12A of the conductive member 12 can be seen from the outer surface side of the inner housing 41 through a space in the hole 23 of the box portion 22. The pair of holding portions 26A, 26B is a pair of holding pieces and the holding portions 26A and 26B extend rearward from rear end portions of an upper wall and a lower wall of the box portion 22, respectively, so as to form a rectangular plate shape. The upper (one) holding portion 26A includes a thick portion 27 and a thin portion 28 that is thinner than the thick portion 27 and is on a rear side of the thick portion 27. The lower (another) holding portion 26B includes the thick portion 27 and the thin portion 28 that is thinner than the thick portion 27 and is on a front side of the thick portion 27. A step is between the thick portion 27 and the thin portion 28 and connects the thick portion 27 and the thin portion 28 in a step-like form. Each of the holding portions 26A, 26B has serrations on the opposing surfaces and the serrations extend in form of grooves. Each of the holding portions 26A, 26B includes a deformed portion 24 at a basal end side thereof and the deformed portion 24 is formed with plastic deformation or elastic deformation when being pressed by the pressing member 30.

The pressing member 30 is made of metal such as copper, copper alloy, aluminum, aluminum alloy, or other materials or made of hard synthetic resin and is formed in a square cylindrical shape that can receive the rear portion of the terminal body portion 21 therein. The pressing member 30 includes an upper and lower pair of pressing portions 31A, 31B in a rear portion thereof and the pressing portions 31A, 31B are for pressing the pair of holding portions 26A, 26B. The pair of pressing portions 31A, 31B are formed by bending an upper wall 30A and a lower wall 30B of the pressing member 30 inwardly. The pressing portions 31A, 31B are formed to extend in an area corresponding to a length of the holding portions 26A, 26B with respect to the front-rear direction such that a distance between the upper wall 30A and the lower wall 30B is small in the area. The pressing member 30 includes a protrusion 33 on an upper surface of a top end portion thereof. The protrusion 33 protrudes upward and has a rectangular parallelepiped shape. The protrusion 33 extends over an entire width of the upper wall 30A of the pressing member 30. The protrusion 33 has a step portion that protrudes from the upper surface of the upper wall 30A and the step portion is a jig receiver 33A that can receive a jig J. The terminal body portion 21 and the pressing member 30 are made by punching and bending a metal plate with a pressing device.

As illustrated in FIG. 3, the housing 40 includes the inner housing 41 in which the terminals 20 are arranged and that is made of synthetic resin and the outer housing 50 that is fit to the inner housing 41 and made of synthetic resin. As illustrated to FIGS. 4 and 5, the inner housing 41 has a flat rectangular parallelepiped shape and includes terminal housing chambers 42 that are arranged in a vertical direction and a right-left direction. The terminal housing chambers 42 on an upper level and those on a lower level are arranged in a zig-zag form. With respect to the right-left direction, the terminal housing chambers 42 on the lower level are arranged such that a middle (a center axis) of the terminal housing chamber 42 on the lower level with respect to the width direction is at a middle between the adjacent terminal housing chambers 42 on the upper level. Each of the terminal housing chambers 42 includes no ceiling wall 43 in the rear portion thereof and is open such that the terminal 20 is exposed through the opening to the outside of the inner housing 41. The ceiling wall 43 includes a front stopper 44 in a rear end portion thereof. The front stopper 44 extends rearward. The front stopper 44 includes a recess portion 44A on a lower surface thereof (an inner surface of the terminal housing chamber 42). The protrusion 33 of the pressing member 30, which is a front portion of the pressing member 30, is in contact with and stopped at the recess portion 44A. The terminal body portion 21 and the pressing member 30 are inserted through the space in the rear portion of the ceiling wall 32 of the inner housing 41 and arranged on a bottom surface of the terminal housing chamber 42.

Figure 5:
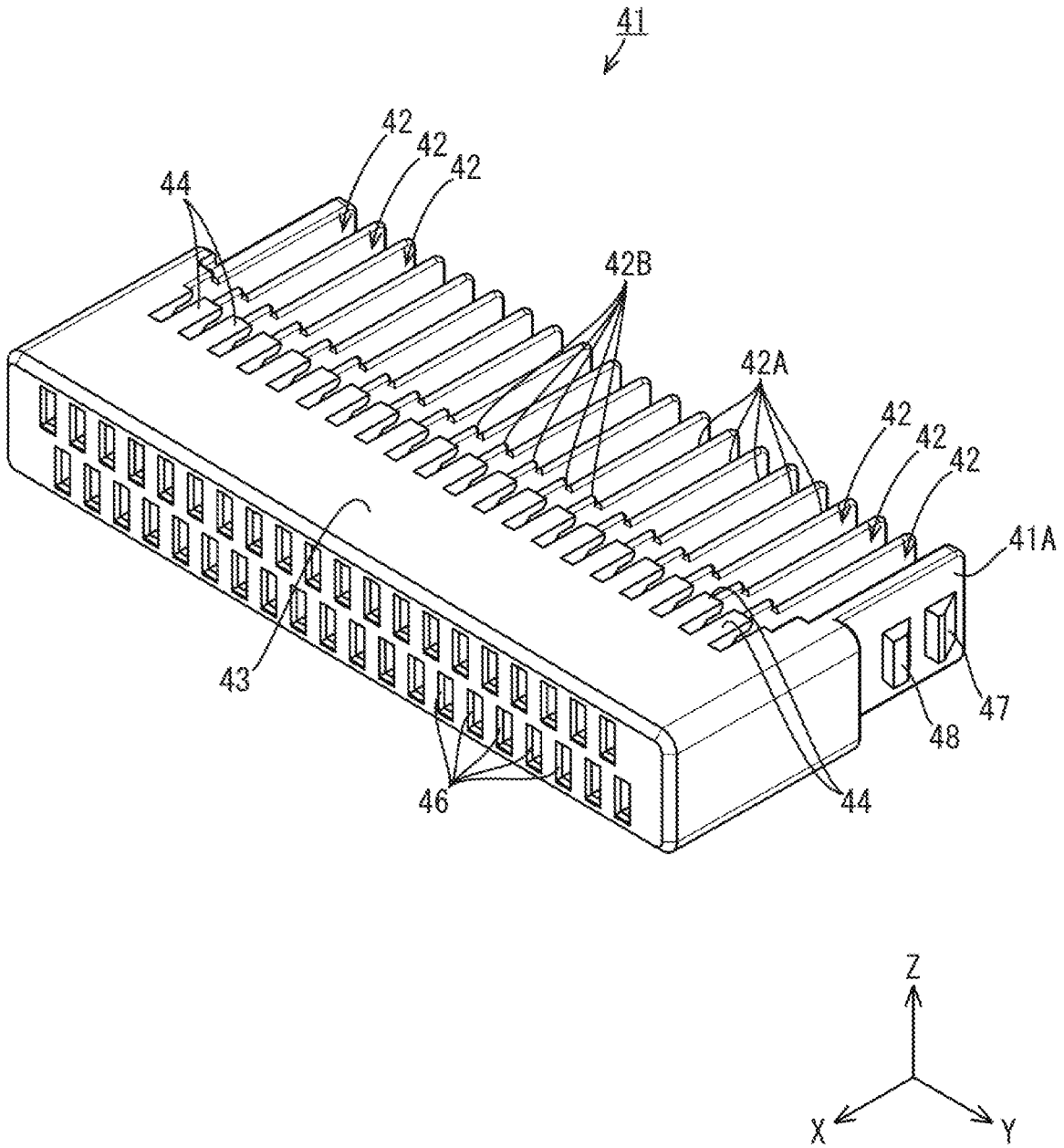
FIG. 5 is a perspective view illustrating an inner housing.

As illustrated in FIG. 5, each terminal housing chamber 42 has a sliding portion 42A on an edge portion of an outer surface of the side wall thereof. Upper and lower opposing walls 65A, 65B of the holding member 60 can slide along the sliding portions 42A. The sliding portion 42A includes a front stopper 42B that forms a step at a front end of the sliding portion 42A. The front stoppers 42B are to be contacted with front ends of the opposing walls 65A, 65B of the holding member 60. The inner housing 41 includes terminal insertion holes 46 in the front wall thereof and the male terminals of the target connector, which is not illustrated, are to be inserted in the terminal insertion holes 46.

The inner housing 41 has recessed portions 41A on outer surfaces of side walls thereof, respectively. The recessed portions 41A are included in rear portions of the respective side walls and recessed inwardly. A fitting stopper 48 and a provisional fitting stopper 47 are arranged in the front-rear direction on the recessed portion 41A and project from the recessed portion 41A. Each of the provisional fitting stopper 47 and the fitting stopper 48 includes a front portion that projects in a step-like form and a rear portion that includes a sloped surface and reduces its projection dimension.

Figure 1:
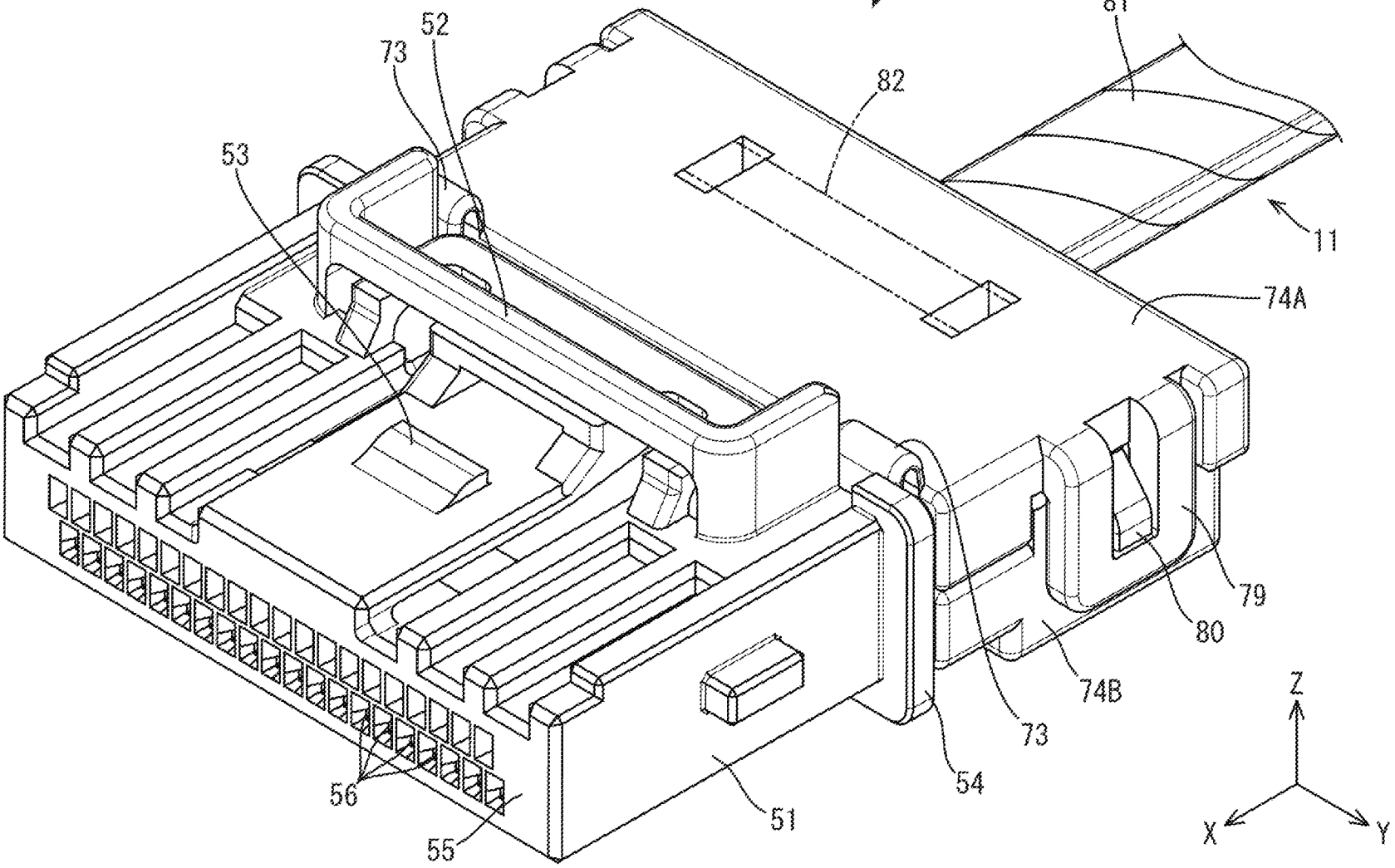
FIG. 1 is a perspective view illustrating a connector according to a first embodiment.
Figure 2:
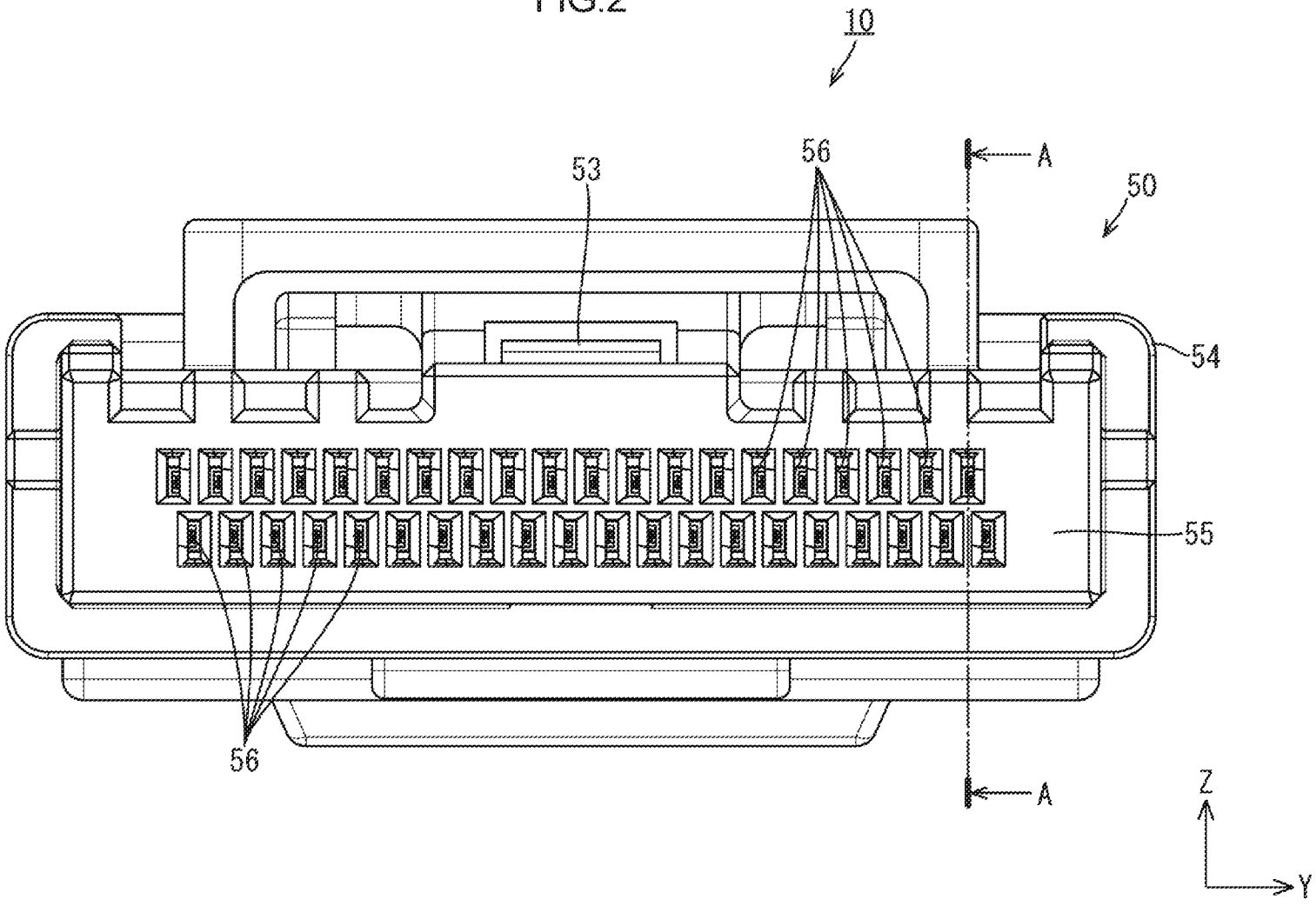
FIG. 2 is an elevation view illustrating the connector.

As illustrated in FIGS. 1 and 3, the outer housing 50 includes a rectangular parallelepiped portion 51 and a front wall 55. The rectangular parallelepiped portion 51 has a rectangular parallelepiped shape and can receive the inner housing 41 therein from the rear side. The front wall 55 closes a front side of the rectangular parallelepiped portion 51. The front wall 55 includes terminal insertion holes 56 where the male terminals of the target connector are inserted. The rectangular parallelepiped portion 51 includes a lock arm 52 that locks fitting of the outer housing 50 and the target connector housing. The lock arm 52 includes a lock projection 53 that is to be fit to the target connector housing in a normal fitting state. The rectangular parallelepiped portion 51 includes flange portions 54 that project outwardly from the rear edge portion thereof. The rectangular parallelepiped portion 51 includes a separation restricting member, which is not illustrated, on the inner surface thereof. The separation restricting member is fit to the outer surface of the inner housing 41 to keep the fitting state where the inner housing 41 is fit in the rectangular parallelepiped portion 51.

Figure 6:
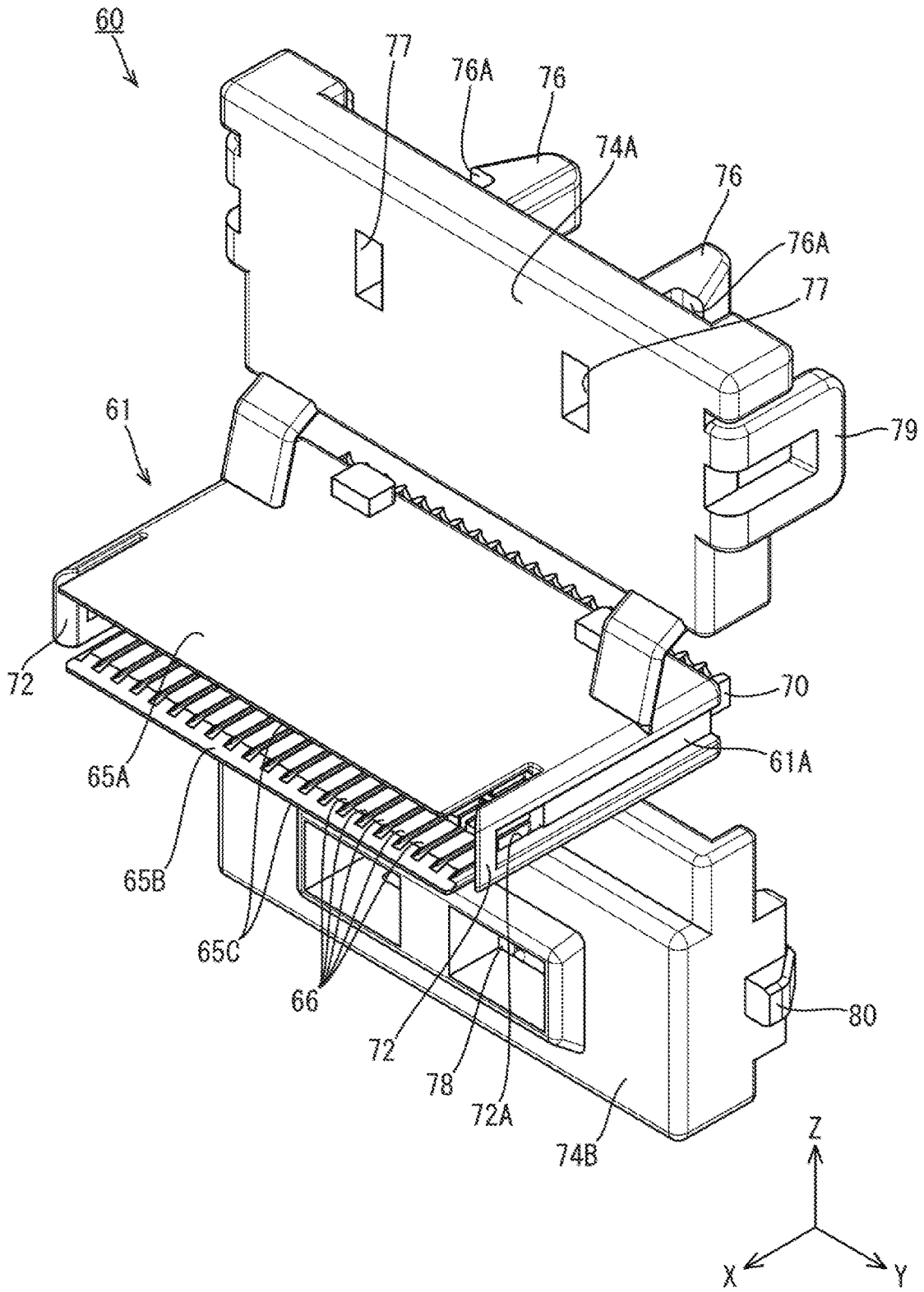
FIG. 6 is a perspective view illustrating a holding member when a pair of cover members is open.

The holding member 60 is made of insulating synthetic resin and, as illustrated in FIGS. 3 and 6, includes a body member 61 and a pair of cover members 74A, 74B. The body member 61 includes terminal insertion holes 63 through which the wires 11 are inserted and has a flat rectangular parallelepiped shape. The cover members 74A, 74B are connected to a rear portion of the body member 61 via hinge portions 73 so as to be pivoted around the hinge portions 73. The hinge portions 73 are formed in a thin belt-like shape and can be deformed to be warped. The body member 61 includes the opposing walls 65A, 65B that project frontward in the front end portion thereof. The body member 61 includes a right and left pair of side walls 61A that connect the edges of the pair of opposing walls 65A, 65B and a pair of fitting frames 72 that extend frontward than the respective side walls 61A.

Figure 8:
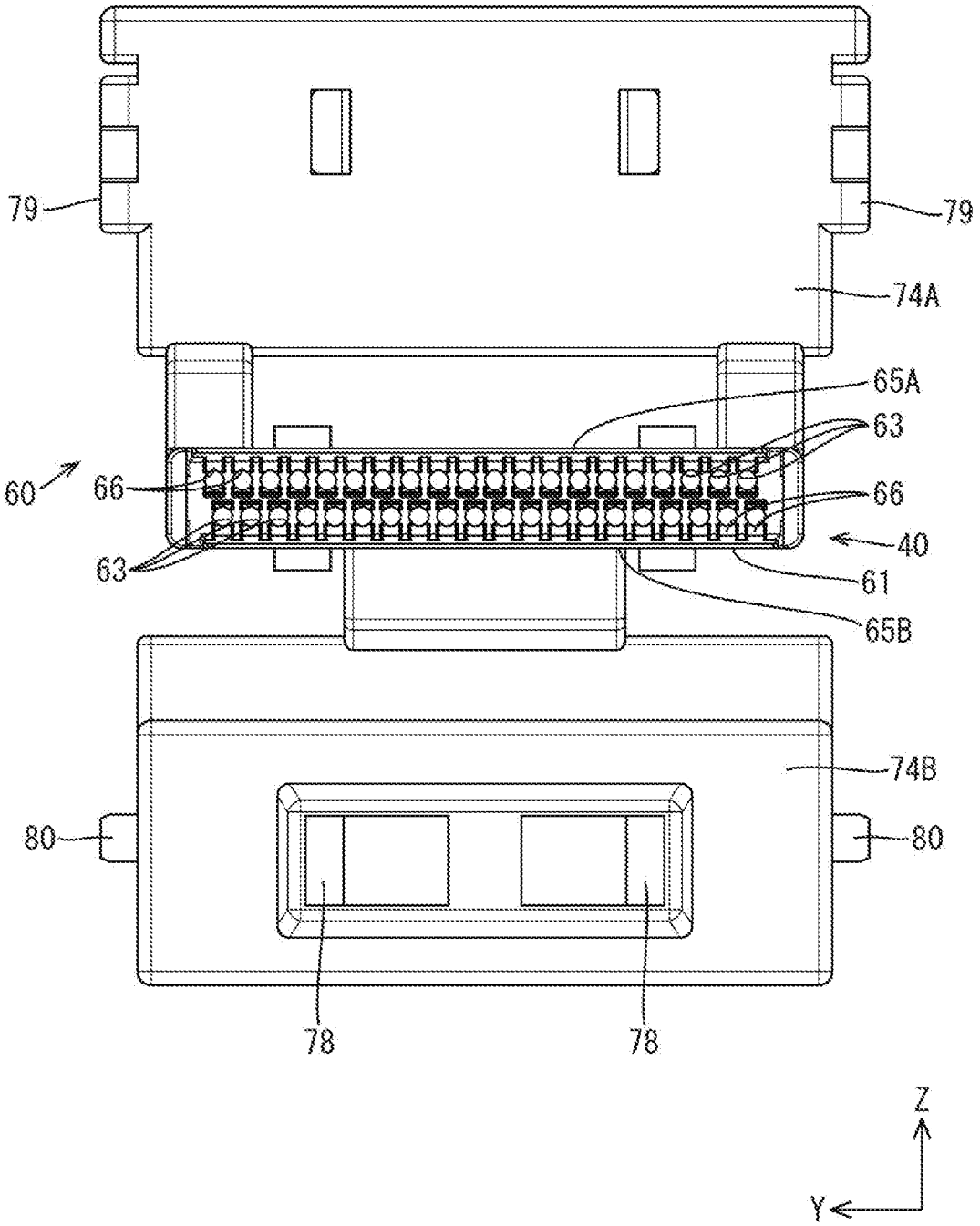
FIG. 8 is an elevation view illustrating the inner housing where the terminals are arranged and the holding member is provisionally fit.

As illustrated in FIG. 8, the body member 61 includes the terminal insertion holes 63 through which the wires 11 are inserted and the terminal insertion holes 63 are arranged in the vertical direction and the right-left direction. The terminal insertion holes 63 on an upper level and those on a lower level are arranged in a zig-zag form. With respect to the right-left direction, the terminal insertion holes 63 on the lower level are arranged such that a middle (a center axis) of the terminal insertion hole 63 on the lower level with respect to the width direction is on a middle between the adjacent terminal insertion holes 63 on the upper level.

The pair of opposing walls 65A, 65B are disposed to be able to slide along the sliding portions 42A of the inner housing 40. As illustrated in FIG. 4, the front edges of the opposing walls 65A, 65B are restricting portions 65C that are contacted with the front stoppers 42B to restrict the body member 61 from moving frontward. The pair of opposing walls 65A, 65B includes projected portions 66 on the inner surfaces thereof and the projected portions 66 extend in the front-rear direction and are arranged in the right-left direction. The projected portions 66 are formed by increasing the thickness of the opposing walls 65A, 65B corresponding to the respective terminals 20 and an distal end portion of each projected portion 66 is sloped such that the thickness is reduced as it extends toward the distal end thereof. A rear end portion of the projected portion 66 includes a contact portion 67 protruding downward in a step-like form and is continuous to the terminal insertion hole 63 via the contact portion 67. The contact portion 67 comes in contact with a rear end of the upper wall 30A of the pressing member 30. When the rear end of the pressing member 30 comes in contact with the contact portion 67 and the front end of the pressing member 30 comes in contact with and is stopped at the recess portion 44A of the front stopper 44 of the inner housing 41, the pressing portions 31A, 31B of the pressing member 30 are positioned in a correct position so as to hold the holding portions 26A, 26B of the terminal body portion 21. A projection piece 68 extends frontward from a portion of the opposing wall 65B that is between the opposing walls 65A and 65B and continuous from a bottom surface of the terminal insertion hole 63. The projection piece 68 comes in contact with the bottom surface of the terminal housing chamber 42 of the inner housing 41.

Figure 7:
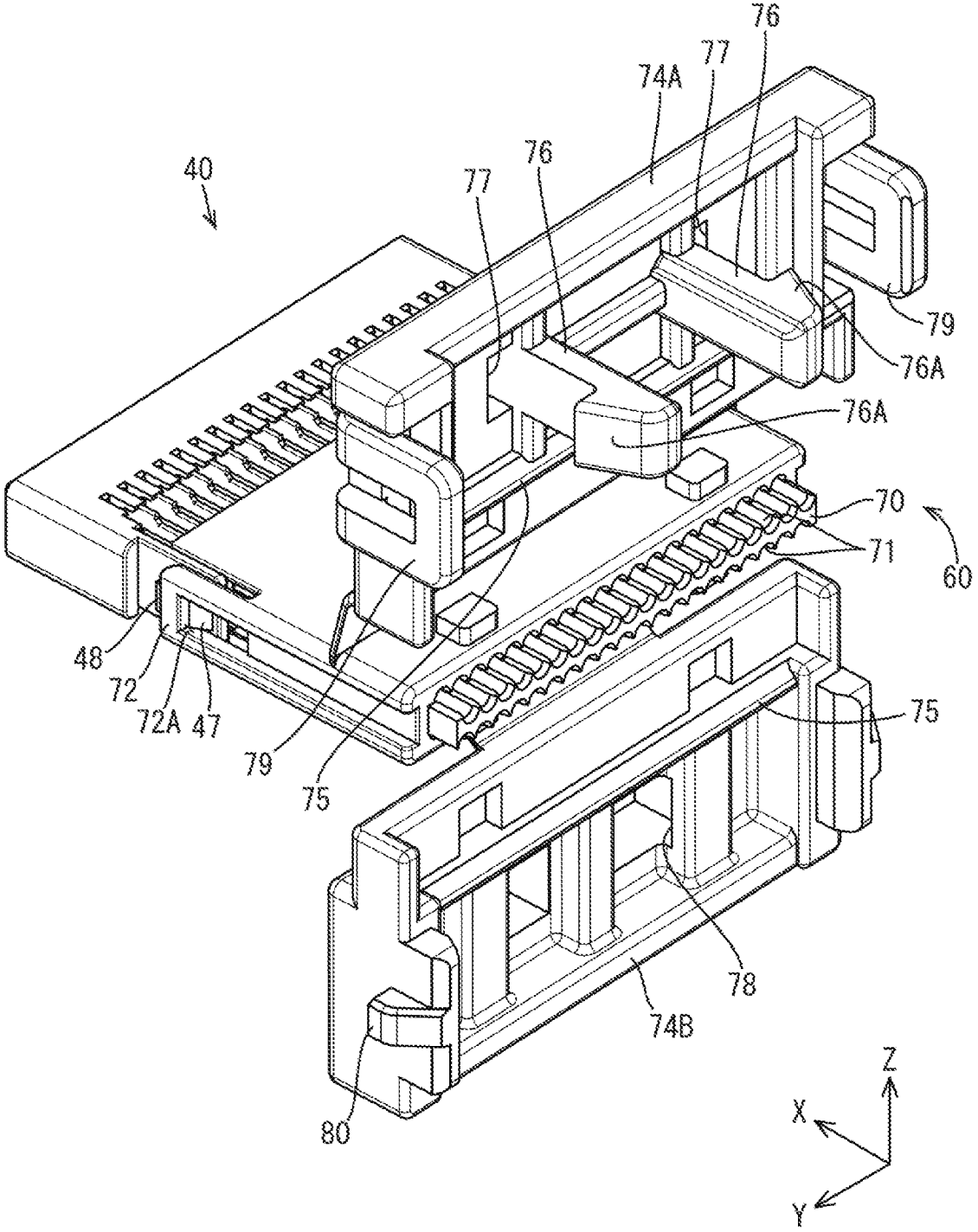
FIG. 7 is a perspective view illustrating the inner housing where terminals are arranged and the holding member is provisionally fit.

As illustrated in FIG. 7, the body member 61 includes a disposing portion 70 extending from a rear portion thereof and the wires 11 are disposed on both surfaces of the disposing portion 70. The disposing portion 70 has wire routing grooves 71 on upper and lower surfaces thereof. The wire routing grooves 71 form a wave shape that extends in the right-left direction to follow outer peripheral surfaces of the wires 11. The wire routing grooves 71 are continuous rearward from the respective terminal insertion holes 63 and are arranged in a zig-zag form on the upper and lower surfaces of the disposing portion 70. Specifically, with respect to the right-left direction, a middle (a center axis) of the wire routing groove 71 on the lower surface of the disposing portion 70 with respect to the width direction is on a middle between the adjacent wire routing grooves 71 on the upper surface of the disposing portion 70. The pair of fitting frames 72 can be deformed to be warped with respect to the right-left direction and has a rectangular fitting hole 72A therethrough. The provisional fitting stopper 47 or the fitting stopper 48 is stopped at a hole edge of the fitting hole 72A.

The pair of cover members 74A, 74B includes wire pressing portions 75 that project toward the wires 11. The wire pressing portions 75 press the wires 11 that are disposed on the wire routing grooves 71 on the both surfaces of the disposing portion 70. The wire pressing portion 75 projects to be formed in a tapered shape and extends over an entire width in the right-left direction. One cover member 74A includes cover fitting pieces 76 and a pair of through holes 77, which are slits. The cover fitting pieces 76 can be deformed to be warped and fit to the other cover member 74B. The cover fitting piece 76 includes a fitting stopper 76A at a distal end thereof. A tying band 82 (refer FIG. 1) made of synthetic resin is used as a tying member for tying the wires 11 and the tying band 82 is inserted through the pair of through holes 77. The wires 11 that are wrapped with the tape 81 are tied up with the tying band 82 to keep the position of the wires 11. The other cover member 74B includes receivers 78 where the respective fitting stoppers 76A are fit. The one cover member 74A includes cover fitting portions 79 extending from side wall surfaces thereof. The cover fitting portion 79 is formed in a frame shape and can be deformed to be warped. The other cover member 74B includes cover fitting stoppers 80 projecting outwardly from outer wall surfaces thereof. The cover fitting stoppers 80 are fit in the respective cover fitting portions 79. When coming in contact with the cover fitting stopper 80, the cover fitting portion 79 is deformed and warped and thereafter, the cover fitting portion 79 restores its original shape and stopped at a hole edge of a cover fitting hole 79A of the cover fitting portion 79. Thus, the pair of cover members 74A, 74B are maintained in a closed state.

A process of producing the connector 10 will be described.

Figure 9:
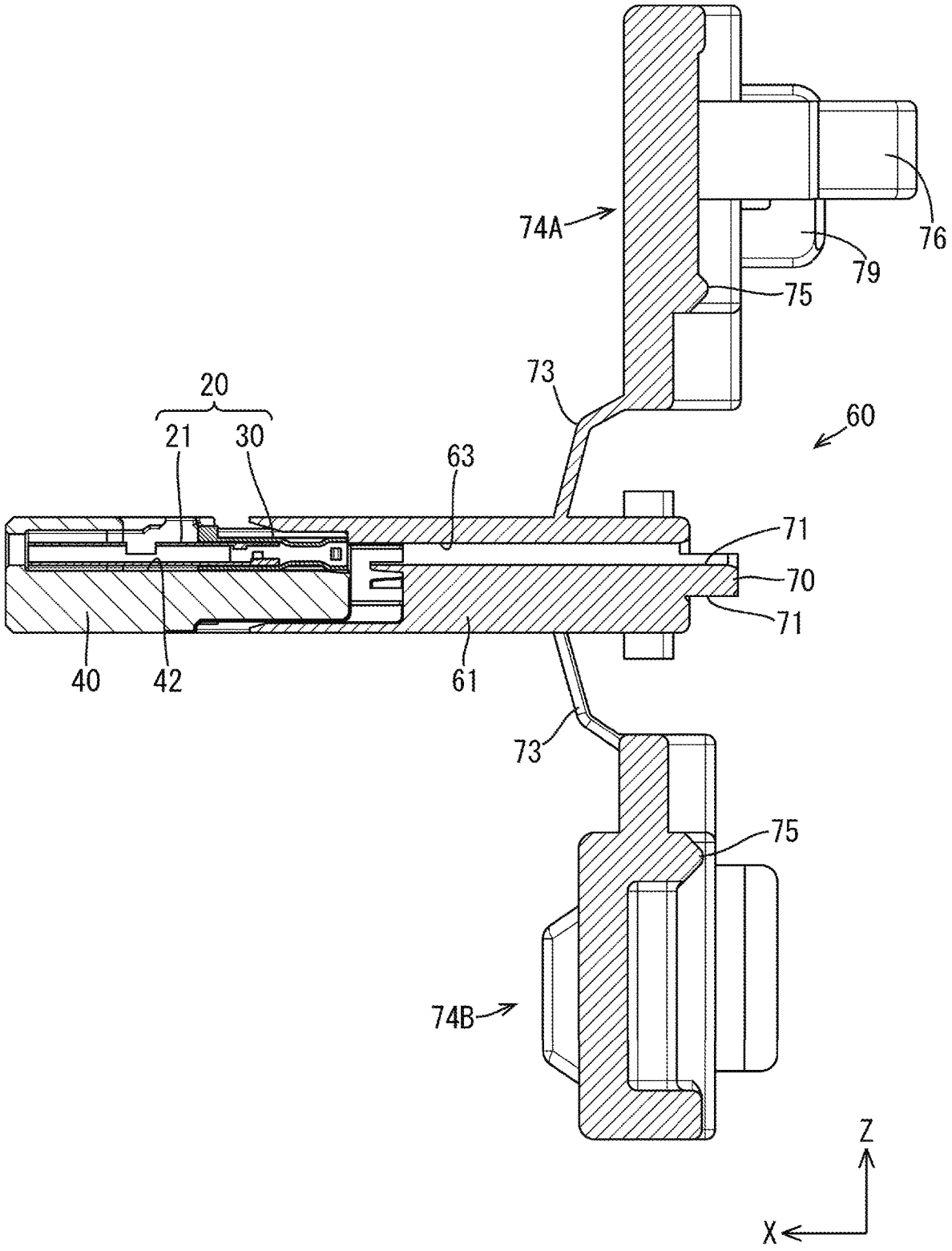
FIG. 9 is a cross-sectional view illustrating the inner housing where the terminals are arranged and the holding member is provisionally fit.
Figure 10:
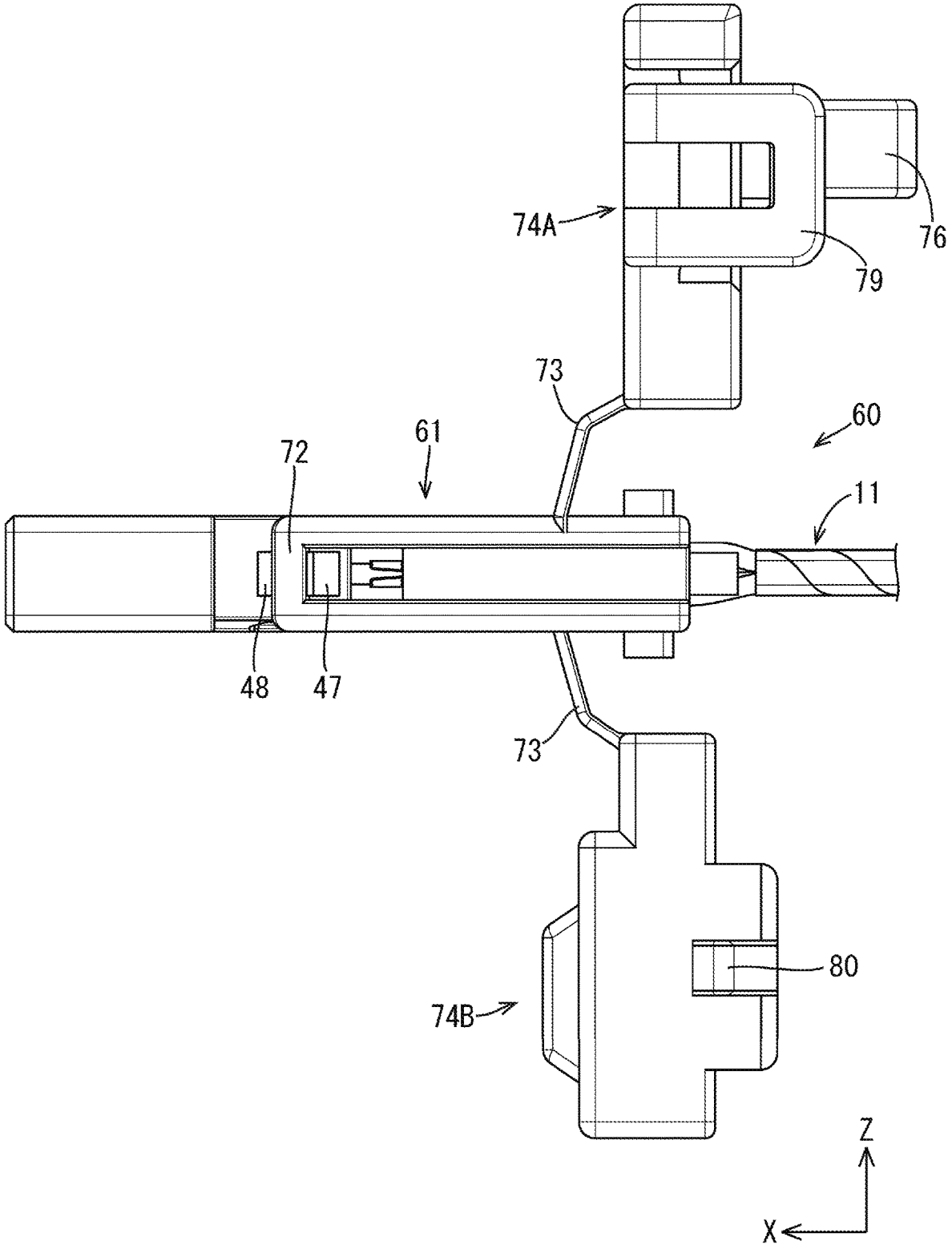
FIG. 10 is a side view illustrating the inner housing where the holding member is provisionally fit and the wires are inserted.

As illustrated in FIG. 9, the pressing member 30 is fit to the rear end portion of the terminal body portion 21 of the terminal 20 and the terminal 20 is set in the terminal housing chamber 42 of the inner housing 41. The holding member 60 is provisionally fit to the inner housing 41 by fitting the fitting frames 72 of the holding member 60 to the provisional fitting stoppers 47 of the inner housing 41 (FIG. 10).

Figure 11:
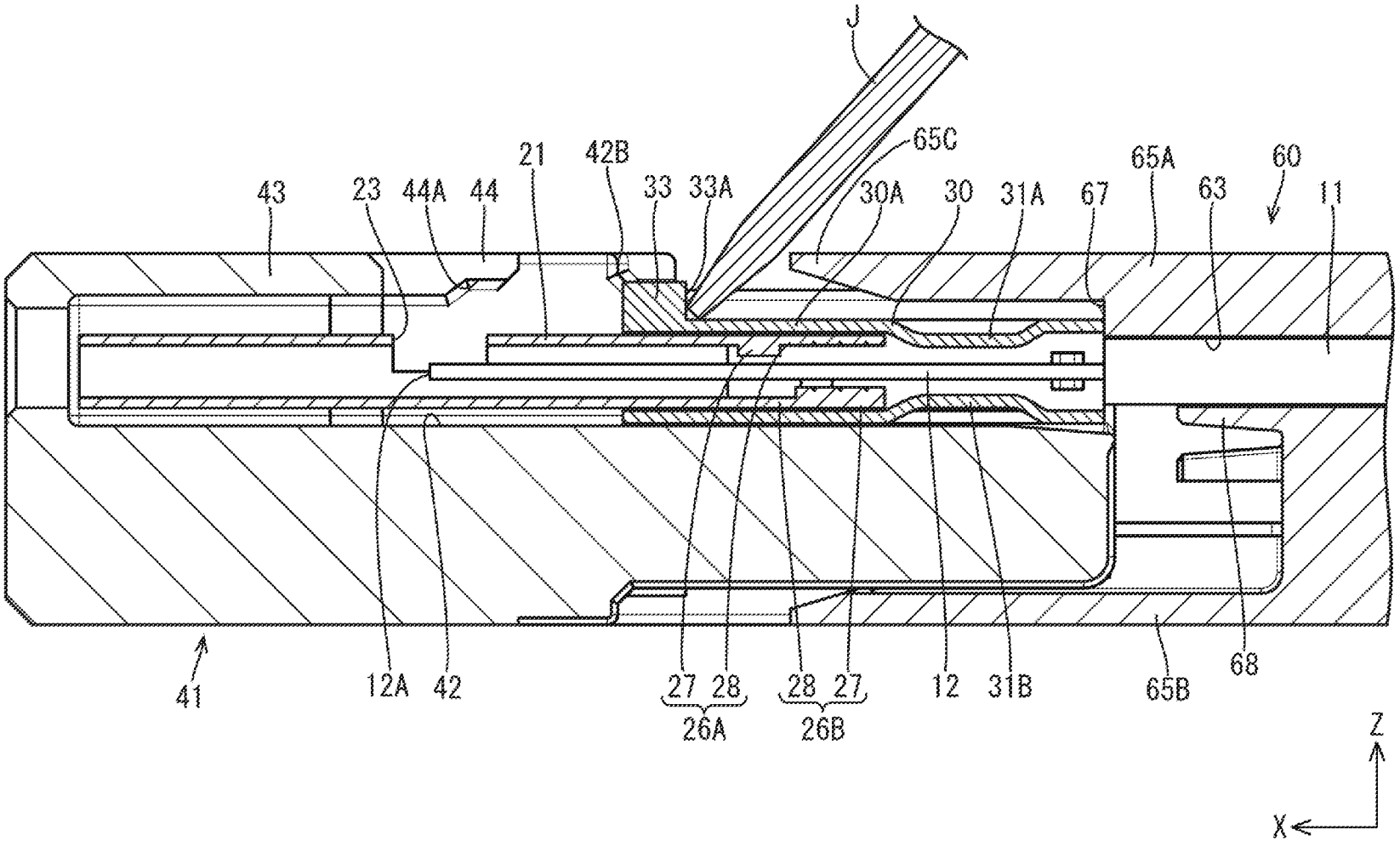
FIG. 11 is an enlarged cross-sectional view illustrating the inner housing where the holding member is provisionally fit and a jig is pressed to a jig receiver of a pressing member.
Figure 12:
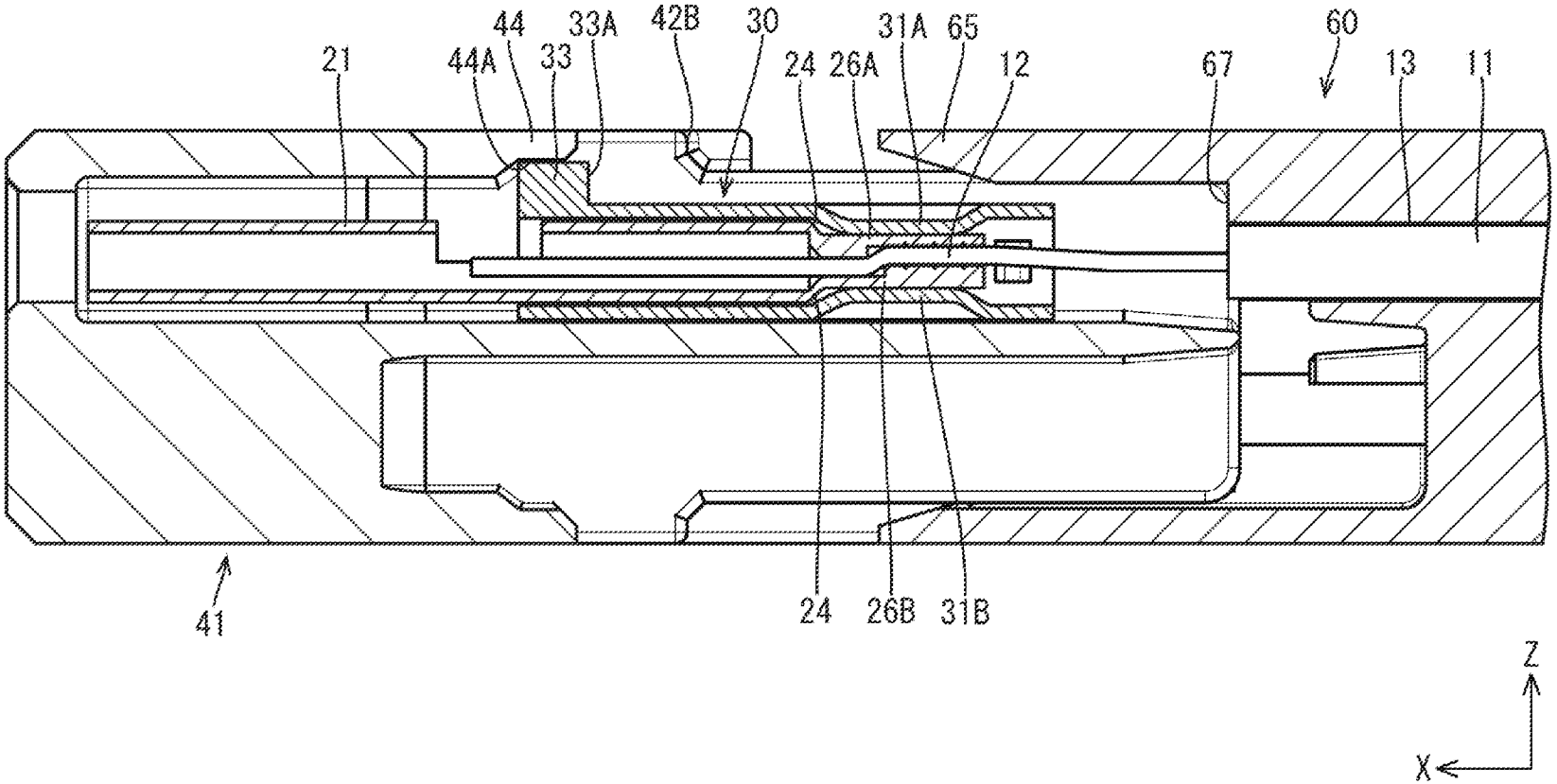
FIG. 12 is an enlarged cross-sectional view illustrating the inner housing where the holding member is provisionally fit and pressing portions of the pressing member press holding portions of a terminal body section and a conductive member is sandwiched by the holding portions.

Next, the covers 13 are removed from the end portions of the wires 11 such that the conductive members 12 are exposed therefrom. The obtained wires 11 are inserted in the terminal insertion holes 63 of the holding member 60 and through the space between the pressing portions 31A and 31B and between the holding portions 26A and 26B. As illustrated in FIG. 11, an operator inserts the wires 11 such that the distal ends 12A of the conductive members 12 of the wires 11 reach the holes 23 while checking and seeing the distal ends 12A of the conductive members 12 through spaces of the holes 23 and from an upper side of the inner housing 41. Next, the operator puts the jig J on the jig receiver 33A of the protrusion 33 of the pressing member 30 and slides the pressing member 30 frontward with respect to the terminal body portion 21. Then, as illustrated in FIG. 12, the terminal body portion 21 is deformed and the deformed portions 24 are formed and the pair of pressing portions 31A, 31B sandwich and press the pair of holding portions 26A, 26B and the pair of holding portions 26A, 26B hold the conductive member 12 of the wire 11.

Figure 13:
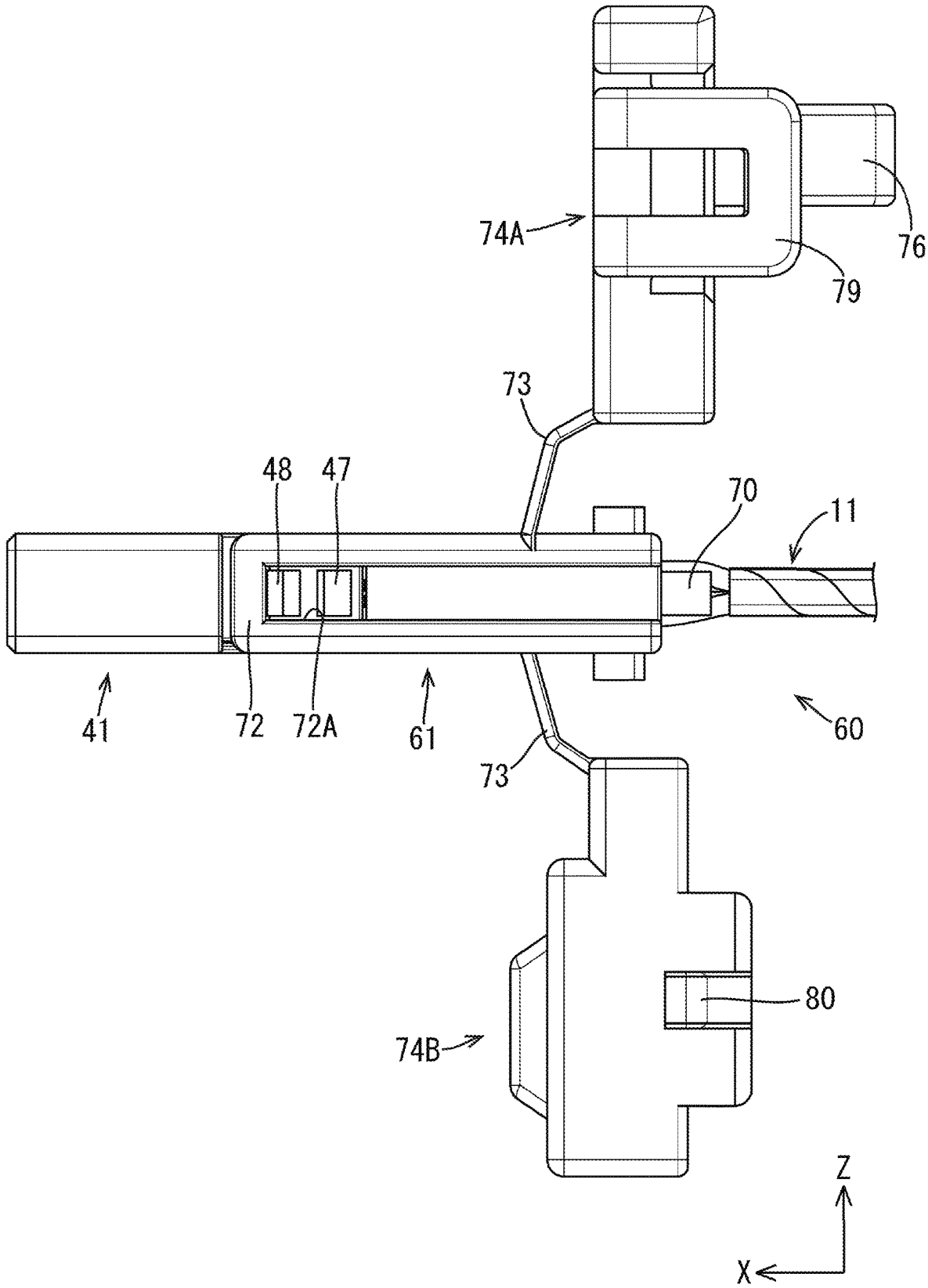
FIG. 13 is a side view illustrating the inner housing where the holding member is fit.
Figure 14:
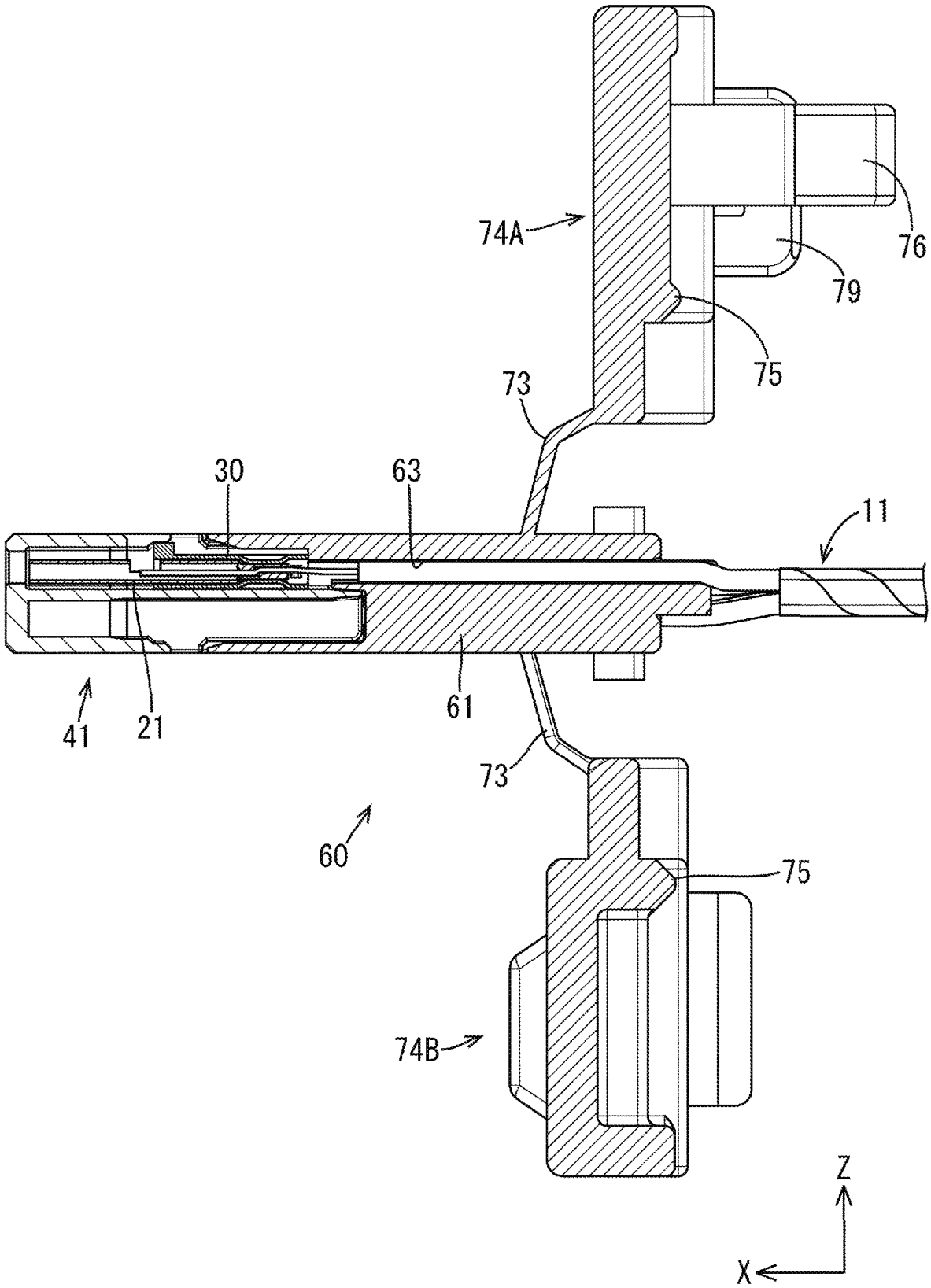
FIG. 14 is a cross-sectional view illustrating the inner housing where the holding member is fit.

Next, the holding member 60 is moved frontward with respect to the inner housing 41. Then, the fitting between the provisional fitting stopper 47 and the holding member 60 is released and the fitting frames 72 that are in contact with the fitting stoppers 48 are deformed and warped. Accordingly, the fitting frames 72 are fit to the fitting stoppers 48 and become in a fitting state. Then, the wires 11 are tied up and the tape 81 is wound around the wires 11 with using a space provided by opening the pair of cover members 74A, 74B (FIGS. 13, 14).

Next, the one cover member 74A is moved to be closed and the tying band 82 is inserted through the through holes 77 and the wires 11 wrapped with the tape 81 are tied up with the tying band 82. The other cover member 74B is moved to be closed and the cover fitting portions 79 and the cover fitting pieces 76 of the one cover member 74A are fit to the cover fitting stoppers 80 and the receivers 78 of the other cover member 74B (see FIGS. 1 and 7). Then, the outer housing 50 is mounted on the inner housing 41 from the front side and the connector 10 is obtained.

According to the embodiment, following operations and effects are obtained.

The connector 10 includes the terminals 20 that are contacted with the conductive members 12 of the wires 11, the housing 40 in which the terminals 20 are arranged, and the holding member 60 that is mounted to the housing 40 and contacted with the terminals 20 to keep the positions of the terminals 20. One of the terminals 20 and the housing 40 includes the pressing portions 31A, 31B that press the conductive member 12 in a direction such that the conductive member 12 comes in contact with the terminal 20.

According to the present embodiment, the pressing portions 31A, 31B press the conductive member 12 in a direction such that the conductive member 12 comes in contact with the terminal 20 after the conductive member 12 of the wire 11 is disposed on the terminal 20. Thus, the wires 11 are connected to the terminals 20. Therefore, compared to a configuration in which the terminals are inserted in the housing after the terminals are connected to the ends of the wires 11 by crimping, the problems such as bending or warping of the wires 11 are less likely to be caused even with the downsized connector 10 and the downsized terminals 20. The connector 10 described before can be downsized while restricting the occurrence of the bending or warping of the wires. However, connection errors may occur between the terminals 20 and the wires 11 due to the wrong positioning of the pressing portions 31A, 31B with respect to the conductive member 12 since the connector 10 is configured such that the pressing portions 31A, 31B press the conductive member 12 in a direction such that the conductive member 12 comes in contact with the terminal 20 to connect the conductive member 12 to the terminal 20. According to the present embodiment, since the holding member 60 that is to be mounted in the housing 40 comes in contact with the terminals 20 to keep the position of the terminals 20, the connection errors that may be caused between the terminals 20 and the wires 11 due to the wrong positioning of the pressing portions 31A, 31B with respect to the conductive member 12 are less likely to be caused.

The terminal 20 includes the holding portions 26A, 26B and the pressing portions 31A, 31B that are separate components from the holding portions 26A, 26B. The holding portions 26A, 26B sandwich the conductive member 12 while being in contact with the conductive member 12.

According to such a configuration, the wires 11 can be connected to the terminals 20 by moving the holding portions 26A, 26B and the pressing portions 31A, 31B relatively each other after setting the holding portions 26A, 26B and the pressing portions 31A, 31B in the housing 40. Therefore, the bending or warping of the wires 11 can be restricted in a configuration including the downsized connector 10 and the downsized terminals 20.

The pressing member 30 including the pressing portions 31A, 31B is sandwiched between the housing 40 and the holding member 60 and positioned.

According to such a configuration, since the pressing member 30 is positioned between the housing 40 and the holding member 60, the holding portions 26A, 26B can keep holding the conductive member 12 of the wire 11 therebetween via the pressing member 30. This can simplify the configuration of the connector 10.

One of the housing 40 and the holding member 60 includes the fitting stopper 48 and the provisional fitting stopper 47. The fitting stopper 48 is fit to another one of the housing 40 and the holding member 60 while fixing the position of the holding portions 26A, 26B and the pressing portions 31A, 31B. The provisional fitting stopper 47 is provisionally fit to the other one of the housing 40 and the holding member 60 while not fixing the position of the holding portions 26A, 26B and the pressing portions 31A, 31B.

According to such a configuration, the housing 40 and the holding member 60 that are provisionally fit each other can be made in the fitting state. This can simplify the fitting operation of the connector 10.

One of the terminal body portion 21 and the pressing member 30 includes the jig receiver 33A where the jig J can be contacted with pressure while the holding member 60 and the housing 40 being provisionally fit each other. The jig receiver 33A that receives the jig J can relatively move the terminal body portion 21 and the pressing member 30 with sliding.

Accordingly, the relative movement of the terminal body portion 21 and the pressing member 30 becomes easy.

The holding member 60 includes the body member 61, the cover members 74A, 74B, and the disposing portion 70. The body member 61 is to be in contact with at least one of the terminal body portion 21 and the pressing member 30. The cover members 74A, 74B are connected to the body member 61 via the hinge portions 73 so as to be pivoted around the hinge portions 73 and cover the wires 11. The disposing portion 70 protrudes from the body member 61 toward the cover members 74A, 74B and the wires 11 are disposed on the disposing portion 70. The cover members 74A, 74B include the wire pressing portions 75, respectively, that press the wires 11 disposed on the disposing portion 70 toward the disposing portion 70.

According to such a configuration, even if the wire 11 receives a force in a direction such that the terminal 20 is to be removed, the wire pressing portions 75 press and hold the wire 11. This reduces stress that may be caused in a connection portion of the wire 11 and the terminal 20.

Other Embodiments

The technology disclosed herein is not limited to the embodiments described above and illustrated in the drawings. For example, the following embodiments will be included in the technical scope of the technology.

(1) The above embodiment includes the inner housing 41 and the outer housing 50. However, the embodiment is not limited to the configuration. For example, one unitary housing may integrally include an inner housing and an outer housing or the housing may not include the outer housing 50 and include only the inner housing 41.

(2) The holding member 60 is configured to be in contact with the pressing member 30 and keep the position of the terminal body portion 21 via the pressing member 30. However, the embodiment is not limited to the configuration and the holding member may be in contact with the terminal body portion 21 and keep the position of the terminal body portion 21 and the pressing member 30.

(3) In the above embodiment, the terminal body portion 21 includes the box portion 22 that is to be connected to a target male terminal. However, the embodiment is not limited to the configuration and the pressing member may include the box portion 22.

(4) The holding member 60 includes the cover members 74A, 74B but may not include the cover members 74A, 74B.

(5) The terminal 20 includes the pressing portions 31A, 31B that press the holding portions 26A, 26B. However, the embodiment is not limited to the configuration and for example, a housing that receives the terminal 20 may include a configuration that presses the holding portions 26A, 26B. The housing may include a configuration that comes directly in contact with the conductive member 12 to press the conductive member 12 toward the terminal.

EXPLANATION OF SYMBOLS

10: connector
11: wire
12: conductive member
13: cover
20: terminal
21: terminal body portion
23: hole
26A, 26B: holding portion
30: pressing member
31A, 31B: pressing portion
33A: jig receiver
40: housing
41: inner housing
42: terminal housing chamber
44: front stopper
47: provisional fitting stopper
48: fitting stopper
50: outer housing
60: holding member
61: body member
65A, 65B: opposing wall
66: projected portion
67: contact portion
68: projection piece
70: disposing portion
71: wire routing groove
72: fitting frame
72A: fitting hole
73: hinge portion
74A, 74B: cover member
75: wire pressing portion
J: jig

The invention claimed is:

1. A connector comprising:

a terminal that is to be contacted with a conductive member of a wire;

a housing in which the terminal is arranged; and a holding member that is fit in the housing and in contact with the terminal to hold a position of the terminal, wherein at least one of the terminal and the housing includes a pressing portion that presses the conductive member in a direction such that the conductive member comes in contact with the terminal, the terminal includes a holding portion that holds the conductive member while being in contact with the conductive member and the pressing portion that is a separate component from the holding portion and presses in a direction such that the holding portion holds the conductive member, and one of the housing and the holding member includes a fitting stopper that is fit to another one of the housing and the holding member while keeping the position of the terminal and a provisional fitting stopper that is provisionally fit to the other one of the housing and the holding member while not keeping the position of the terminal.

2. The connector according to claim 1, wherein the pressing portion is sandwiched between the housing and the holding member to be positioned.

3. The connector according to claim 1, wherein the terminal includes a jig receiver that is configured to receive a jig when the holding member is provisionally fit in the housing, and the jig receiver that receives the jig allows a relative position of the holding portion and the pressing portion to be moved with sliding.

4. The connector according to claim 1, wherein the holding member includes a body member that is to be in contact with the terminal, a cover member that is pivotably connected to the body member via a hinge portion, and a disposing portion that protrudes from the body member toward the cover member and on which the wire is disposed, and the cover member includes a wire pressing portion that presses the wire disposed on the disposing portion toward the disposing portion.

5. A connector comprising:

a terminal that is to be contacted with a conductive member of a wire;

a housing in which the terminal is arranged; and a holding member that is fit in the housing and in contact with the terminal to hold a position of the terminal, wherein at least one of the terminal and the housing includes a pressing portion that presses the conductive member in a direction such that the conductive member comes in contact with the terminal, the holding member includes:

a body member that is to be in contact with the terminal, a cover member that is pivotably connected to the body member via a hinge portion, and a disposing portion that protrudes from the body member toward the cover member and on which the wire is disposed, and the cover member includes a wire pressing portion that presses the wire disposed on the disposing portion toward the disposing portion.

6. The connector according to claim 5, wherein the terminal includes a holding portion that holds the conductive member while being in contact with the conductive member and a pressing portion that is a separate component from the holding portion and presses in a direction such that the holding portion holds the conductive member.

7. The connector according to claim 6, wherein the pressing portion is sandwiched between the housing and the holding member to be positioned.

8. The connector according to one of claim 6, wherein one of the housing and the holding member includes a fitting stopper that is fit to another one of the housing and the holding member while keeping a position of the terminal and a provisional fitting stopper that is provisionally fit to the other one of the housing and the holding member while not keeping the position of the terminal, and wherein the terminal includes a jig receiver that is configured to receive a jig when the holding member is provisionally fit in the housing, and the jig receiver that receives the jig allows a relative position of the holding portion and the pressing portion to be moved with sliding.

* * * * *